62-FII
10/15/85 4,546,610

United States Patent [19]
Zwick

[11] Patent Number: 4,546,610
[45] Date of Patent: Oct. 15, 1985

[54] PREVAPORIZING COMBUSTION METHOD

[76] Inventor: Eugene B. Zwick, 5471 Argosy Ave., Huntington Beach, Calif. 92646

[21] Appl. No.: 408,509

[22] Filed: Aug. 16, 1982

Related U.S. Application Data

[60] Continuation of Ser. No. 115,959, Jan. 28, 1980, abandoned, which is a division of Ser. No. 615,166, Sep. 22, 1975, Pat. No. 4,255,116.

[51] Int. Cl.[4] ..... F17C 7/02
[52] U.S. Cl. ..... 62/52; 62/511; 165/174
[58] Field of Search ..... 62/511, 527, 504, 52; 165/174

[56] References Cited

U.S. PATENT DOCUMENTS

| | | | |
|---|---|---|---|
| 1,748,121 | 2/1930 | Gay | 165/174 |
| 1,893,270 | 1/1933 | Caldwell | 165/174 |
| 2,310,234 | 2/1943 | Haug | 165/174 |
| 2,707,868 | 5/1955 | Goodman | 165/174 |
| 3,073,575 | 1/1963 | Schulenberg | 165/174 |
| 3,209,820 | 10/1965 | Lauterbach | 165/174 |
| 3,864,938 | 2/1975 | Hayes, Jr. | 62/511 |
| 4,038,970 | 8/1977 | D'Ascoli et al. | 165/174 |

*Primary Examiner*—Ronald C. Capossela
*Attorney, Agent, or Firm*—Beehler, Pavitt, Siegemund, Jagger & Martella

[57] ABSTRACT

Time dependent fluctuations in a low pressure drop heat exchanger can be prevented by incorporating an improvement into the heat exchanger and practicing a method relating to the pressure drop across the heat exchanger tubes. The improvement comprises an orifice at or near the inlet of the tube wherein the flow flowing into the tube at a liquid inflow rate enters the tube in the liquid state and is then converted while in the tube into a gaseous state at some point downstream from the orifice. The tube is characterized at a given pressure. The fluid, now in a gaseous state, exits the tube at a gas outflow rate. The orifice is disposed at the input of the tube and is sized to provide an inlet pressure drop across the orifice to the liquid which enters the tube at a magnitude equal to a fractional portion of the low pressure drop across the tube itself. This magnitude is at least large enough so that the absolute magnitude of the change in the gas outflow rate produced by any given change in the tube pressure is greater than the absolute magnitude of the change in the liquid inflow rate produced by the same given change in the tube pressure.

4 Claims, 3 Drawing Figures

PREVAPORIZING COMBUSTION METHOD

This is a continuation of application Ser. No. 115,959, filed Jan. 28, 1980, now abandoned, which is a divisional application of Ser. No. 615,166, filed Sep. 22, 1975, now U.S. Pat. No. 455,116.

The present invention pertains to an improved burner, an improved means for vaporization of fuel in supplying a mixture of air and vaporized fuel to the combustion zone of the burner, and an improved heat exchanger in which means are provided to reduce fluctuations in the flow velocity of a medium, such as nitrogen, which is being heated within the heat exchanger.

In illustrating a preferred embodiment of the invention, reference is made to the accompanying drawings in which.

Figure 1:
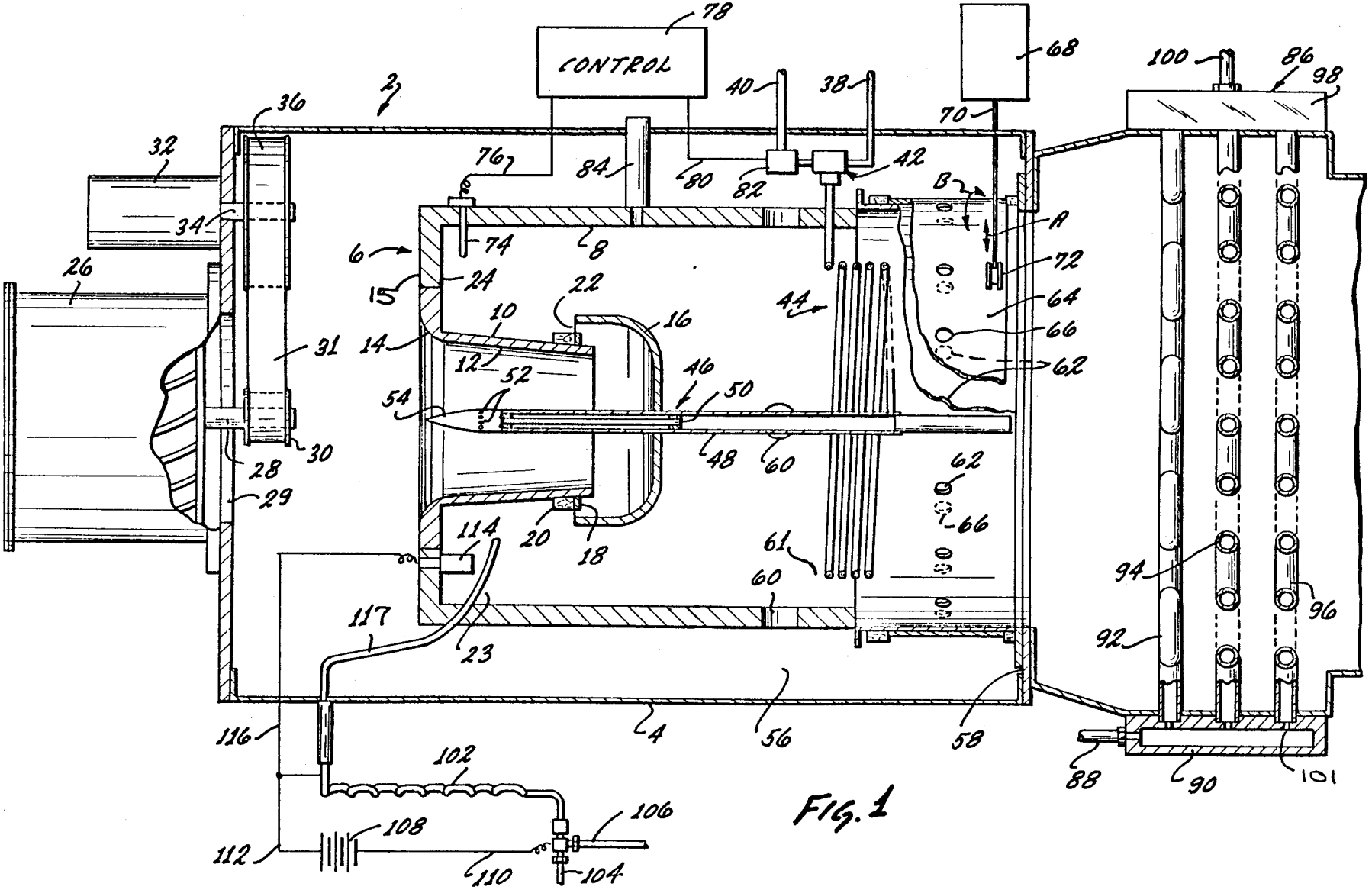
FIG. 1 is a top sectional view of a burner which includes a fuel vaporizer positioned within a zone of the burner that is maintained at a relatively constant temperature to vaporize the fuel without thermally degrading the fuel to cause coking.

Turning to FIG. 1, a burner generally indicated as 2 includes an outer shell 4 and a burner body generally indicated as 6. The burner body 6 includes a cylindrical wall 8 and an inlet throat 10. As indicated, the throat 10 has an inwardly tapered interior surface 12 to assist in preventing flow separation and includes a curved portion which merges with the burner end wall 15. A dome-shaped flow deflector 16 is positioned adjacent the inner end of inlet throat 10 with the result that material flowing into the burner body 6 through the inlet throat is deflected by the flow deflector so that the material undergoes a change in direction of about 180°.

A ring 18 positioned about the exterior surface of throat 10 partially closes the space between the interior surface of the flow deflector 16 and the exterior surface of the inlet throat. An insulation collar 20 is formed about the exterior surface of the inlet throat with the collar in contact with the downstfeam surface of the ring 18 to protect the downstream surface from excessive heat. As indicated, the exterior surface of the collar 10 merges smoothly with the exterior surface of the ring 18 such that the two form essentially a straight line.

An annular inlet opening 22 is formed between the interior surface of the ring 18 and the interior surface of the flow deflector 16. In entering a combustion zone 23, a homogeneous mixture of fuel and air is introduced through the inlet opening 22 with the mixture then igniting to produce a flame which moves rearwardly within the burner body 6 into contact with the back wall surface 24. After contacting the back surface 24, the flame front and mixture of combustible gases reverse direction to then flow forwardly within the burner body 6.

A blower 26 is connected to the back wall surface of the outer shell 4 to provide a flow of air through an opening 29 into the interior of the outer shell. The blower 26 is connected to a shaft 28 having a sheave 30 connected to its inner end with the sheave being driven by a belt 31. A motor 32, which may also be positioned on the back wall surface of the outer shell 4, drives a shaft 34 having a sheave 36 connected to its inner end.

Sheave 36, thus, receives power from the motor 32 and transmits the power through belt 31 to the sheave 30 and to the blower 26.

As described, a portion of the air which is introduced into the outer shell 4 by the blower 26 passes into the inlet throat 10 and then through the annular inlet opening 22. The remainder of the air which is introduced into the shell 4 flows forwardly through an annular air passage 56 that is formed between the outer shell and the burner body 6. The air passage 56 is closed by an end closure member 58 with the result that all of the air which is introduced must flow into the burner body 6.

A plurality of secondary air inlet openings 60 are formed in the burner wall 8 with the secondary openings being positioned downstream from the combustion zone 23. With the flow area of the annular inlet opening 22 being fixed and the flow area provided by the secondary air inlet openings 60 being fixed, there is a fixed area ratio which determines the proportion of air introduced through the annular inlet opening with respect to the air that is introduced through the secondary air inlet openings. In a particular burner which I have constructed, the flow area provided by the annular air inlet opening 22 is about 20 square inches and the flow area provided by the secondary air inlet openings 60 was about 40 inches, thus providing a flow split between air entering combustion zone 23 to air entering the secondary air inlet openings 60 of about 1 to 2. Assuming that three volumes of air enter the outer shell 4 through the blower 26, one volume of air then passes through the annular inlet opening 22 into the combustion zone 23 while two volumes of air enter through the air inlet openings 60. The effect of the secondary air inlet openings 60 is to cool the combustion gases from the combustion zone 23 and to, thereby, provide a secondary dilution zone 61 having a relatively constant temperature, such as about 800 to about 1200° F. The secondary dilution zone 61 functions in transferring heat from the combustion gases to fuel which is being vaporized within vaporizer coil 44 at a temperature below the thermal degradation temperature of the fuel.

A further series of openings 62 in the burner wall 8, which are termed tertiary air inlet openings, are positioned downstream from the secondary air inlet openings 60, and downstream from the vaporizer coil 44. A cylindrical slide member 64 is positioned about the burner wall 8 in overlying relation to the tertiary inlet openings 62. The cylindrical slide member 64 includes a plurality of slide openings 66 which may correspond in number and placement to the tertiary inlet openings. Through use of a motor 68 coupled with a control rod 70 and a control bracket 72 which connects the control rod to slide member 64, the slide member may be rotated with respect to the burner wall 7 to open, close or partially close the tertiary air inlet openings 62 through alignment or misalignment of slide openings 66 with the tertiary air inlet openings 62. An arrow A indicates the movement of the control rod 70 while an arrow B indicates the corresponding movement of slide member 64.

With the slide member 64 in a closed position, all of the incoming air passes through the annular inlet opening 22 and the secondary air inlet openings 60. As discussed, this provides a fixed flow split between the air entering the primary combustion zone 23 and the air which enters through secondary air inlet openings 60 in providing the secondary dilution zone 61. When the slide member 64 is moved to a completely open position such that the tertiary air inlet openings 62 are completely exposed, a portion of the air introduced into shell 4 then flows through the tertiary air inlet openings. This results in a reduction in the air flow through the annular inlet opening 22 and the secondary air inlet openings 60. However, due to the fixed ratio between the flow area provided by air inlet opening 22 as compared with the flow area provided by secondary air inlet openings 60, the ratio of the air flow to the combustion zone 23 with respect to the air flow to the secondary dilution zone 61 remains relatively constant.

By way of example, if the flow area provided by the air inlet opening 22 is about 20 square inches, the flow area provided by secondary air inlet openings 60 is 40 square inches, and the flow area provided by tertiary air inlet openings 62 is 120 square inches, then with a total air flow volume of three units, one-third unit theoretically passes through annular air inlet opening 22, two-thirds of a unit theoretically passes through secondary air inlet openings 60, and two units theoretically pass through the tertiary air inlet openings 62. This would give a total volume of three units with the ratio of air flow to the combustion zone 23 remaining constant with respect to the cooling air flow to the secondary air dilution zone 61.

In practice, the air flow through a blower, such as blower 26, will vary with respect to the air flow resistance which is encountered. Thus, the air output from the blower increases as the air flow resistance is reduced. The theoretical air flow split of one-third volume, two-thirds volume and two volumes with the slide member 64 in an open position is, thus, not obtained precisely in practice. In practice, with slide member 64 in an open position, there is less resistance to air flow and the air output from blower 26 is, thus, slightly increased from the air output provided with slide member 64 in a completely closed position. With slide member 64 in a completely open position, the air flow from the blower 26 may be increased from, for example, three units to three and one-quarter units. Assuming three and one-quarter units of air flow, rather than three units with slide member 64 completely closed, the air flow split may then be one-half unit to the combustion zone 23, one unit to the secondary dilution zone 61, and one and three-quarters units to the tertiary air inlet openings 62. As indicated, even though total air flow increases somewhat with the slide member 64 in a completely open position, the ratio of air flow through the annular inlet opening 22 with respect to the air flow through secondary air inlet openings 60 remains relatively constant.

With the opening or closing of slide member 64, the mass flow rate of air to the combustion zone 23 is altered considerably, even though the ratio of air flow between the combustion zone and secondary dilution zone remains relatively constant.

When the slide member 64 is moved from an open to a closed position, the mass air flow rate into the combustion zone 23 is increased. In order to maintain stable combustion while, if desired, also providing low emission combustion, it is necessary to vary the fuel flow rate to the combustion zone 23 such that the fuel-to-air ratio within the combustion zone remains relatively constant to provide a relatively constant combustion temperature within a desired range.

In controlling the fuel flow rate to combustion zone 23, a temperature sensor 74 extends into the combustion zone with the sensor being connected through a wire 76 to a standard control device 78. When the combustion temperature within combustion zone 23 momentarily increases, as occurs when the fuel flow to the combustion zone is maintained constant while air flow to the combustion zone is reduced, the control device 78 emits a signal through a wire 80 which controls the opening through valve 82 which regulates the fuel flow through fuel passage 40. If the temperature within the combustion zone is increasing above a desired level, the signal transmitted by control device 78 reduces the opening through valve 82 to reduce the fuel flow rate to the combustion zone 23. Conversely, if the temperature within the combustion zone 23 is decreasing below a desired level, the control device 78 transmits a signal to the valve 82 which increases the valve opening to, thereby, increase fuel flow to the combustion zone 23.

In effectively controlling the fuel-to-air ratio within the combustion zone 23 to maintain the temperature within both the combustion zone 23 and the dilution zone 61 relatively constant, it is desirable that the fuel supply system to the combustion zone have a relatively fast response time such as about one second or less. As will be discussed subsequently, by controlling the number of separate coils employed in the vaporizer coil generally indicated as 44, the response time can be reduced. Also, as will be discussed, by carrying the fuel through the vaporizer coil 44 in a stream of air in what is known as dispersed flow, the hold-up time within the vaporizer coil 44 may also be reduced to improve the response time for the fuel supply system.

In the movement of the slide member 64 between an open and closed position, or vice versa, the conditions within the burner undergo considerable change to maintain the temperature within the combustion zone 23 at a relatively constant desired level while increasing or reducing the mass air flow rate to the combustion zone 23. Thus, to provide smooth operation of the burner 2, the time required for movement of the slide member 64 between an open and a closed position is preferably coordinated with the response time of the fuel supply system in either increasing or reducing the fuel supply to the combustion zone 23. In a burner which I have constructed which embodies the principles of the present invention, the rate of movement of the slide member 64 has been controlled for movement between an open and a closed position so as to coordinate with a fuel response time of about one second. As stated, the fuel response time is determined by the number of individual coils in vaporizer coil 44 and by carrying of the fuel through the vaporizer coil in a stream of air. In providing a controlled movement, the slide member 64 may, for example, be actuated through a hydraulic system which contains a choke or orifice that restricts the flow of hydraulic fluid to a piston which moves the slide member. The present invention is not restricted to any particular means for controlling the speed of movement of the slide member 64 and any known means may be employed.

If desired, the burner 2 may also include a sight glass 64 through which the combustion may be viewed from a point outside the shell 4. In the operation of the present burner, the fuel and air are preferably mixed thoroughly before their introduction to the combustion zone 23 with the result that the fuel-to-air ratio is quite uniform within the combustion zone. Further, through use of the outer wall 48 which surrounds the inner tube 50 in the fuel supply tube 46, fuel which has been vaporized within vaporizer coil 44 is not recondensed through contact of cool air with the exterior surface of the fuel supply tube. Also, the air flow rate through the opening 22 is maintained sufficiently high to prevent flashback to the point of mixing of the fuel and air. As described in copending prior application Ser. No. 313,681, filed Dec. 11, 1972, combustion processes can be conducted to reduce emissions of nitrogen oxide, carbon monoxide and unburned hydrocarbons to a reasonable level by controlling the combustion parameters. Preferably, the burner of the present invention is operated in this manner. When so operated, there is no visible flame within the burner body 6 as would be produced if there were locally fuel-rich pockets or fuel-lean pockets within the burner. The presence of such pockets permits the formation of nitrogen oxides or the formation of carbon monoxide and unburned hydrocarbon pollutants which are undesirable. Accordingly, with homogeneous combustion conditions prevailing throughout the burner body 6, the viewer observes not only hot surfaces within the burner body but does not see any flame.

After passing from the burner body 6, the combustion gases are conveyed to a heat exchanger generally indicated as 86. In a particular burner which I have built that includes the principles of the present burner, the exhaust gases were utilized to vaporize liquid nitrogen. Thus, in discussing the functioning of heat exchanger 86, reference will be made to the manner in which it may be used to vaporize liquid nitrogen.

Material, such as liquid nitrogen, is introduced through an input line 88 to a manifold 90 that is connected to a plurality of parallel tubes such as 92, 94 and 96. Each of the tubes, as illustrated, may pass back and forth across the heat exchanger with 180° bends being formed in the tubes each time they undergo a change in direction. After passing through the heat exchanger, the tubes 92, 94 and 96 may then enter a manifold 98 which collects the heated material, such as gaseous nitrogen. An exhaust passage 100 leads from the manifold 98 and may be used to convey the heated material away for use in any desired purpose.

In using a heat exchanger, such as heat exchanger 86, it is desirable to reduce flow fluctuation within a given heat exchanger tube from one period of time to another and it is also desirable to reduce flow variation between individual heat exchanger tubes. In accomplishing this result, I have employed a plurality of orifices 101, each of which connects a heat exchanger tube to the manifold 90. The material flowing from the manifold 90 into the heat exchanger tubes undergoes a substantial pressure drop in passing through an orifice 101. This pressure drop is relatively large with respect to the resistance to fluid flow within any given tube. Thus, any variations in fluid flow resistance due to changes in density of the material causes only a relatively small change in the flow rate of the material through the heat exchanger tube.

Further, the use of orifices 101 reduces flow variation as between individual heat exchanger tubes. For example, one of the tubes, e.g., tube 94, may have a slightly lesser or greater resistance to liquid flow than another of the tubes such as tube 92. Thus, if it were not for the presence of orifices 101, the flow rate of material through tube 94 would be either greater or less than the flow rate through tube 92. However, since the pressure drop through the orifices 101 is considerably greater than the difference in resistance to fluid flow between individual tubes, these differences in fluid flow resistance do not cause any great difference between the flow rate in one tube as compared with that in another.

The operation of my burner has been described to this point in terms of its operation after start-up when the vaporizer coil 44 is receiving heat at a controlled rate from the combustion gases. During start-up, the operating conditions within the burner are considerably different. At start-up, the blower 26 is turned on, which supplies air to the inlet throat 10. Compressed air is also supplied to air passage 38, to the vaporizer coil 44 and also to an air line 104 to a starting coil 102. Additionally, compressed air is supplied to any valves such that a valve may be used to move the slide member 64 to an open position to reduce the mass air flow rate into the combustion zone 23. Following this, a switch (not shown) is actuated to supply power from a power source 108 through starting coil wires 110 and 112 to resistively heat the starting coil 102. Also, at the same time, power is supplied through a spark plug wire 116 to a spark plug 114 which is located within the combustion zone 23. If a large enough spark plug 114 were utilized, it would be possible to start the burner 2 merely by spraying liquid fuel into contact with the spark plug. However, I have found it preferable to supply the starting fuel in an air stream by feeding the fuel from a fuel line 106 into a stream of air introduced through the air line 104.

After waiting a suitable time, such as about twenty seconds, the starter coil 102 begins to glow and fuel is then admitted into the starter coil through fuel line 106. With the particular power source 108 which I employed, there was insufficient power to continuously vaporize the fuel as it passed through the starter coil 102 in admixture with an air stream. Rather, the heat which was stored within the starter coil 102 was sufficient to vaporize the fuel flowing through the coil for approximately about three seconds. Following this, the fuel which passed through the starter coil did not receive sufficient heat to undergo vaporization.

The mixture of vaporized fuel and air which emerges from the starter coil 102 is transmitted through a fuel injection tube 117 that is positioned within the combustion zone 23. The injection tube 117 is positioned to discharge the fuel-air mixture in a generally tangential direction with respect to the exterior surface of the inlet throat 10. After discharge, the fuel-air mixture swirls within the combustion zone 23 and comes into contact with the spark plug 114 to cause ingition. If ignition does not occur within three seconds after admission of fuel to the starting coil 102, the fuel flow may then be shut down, for reasons of safety, and the starter coil reheated with the procedure being repeated a second time.

After ignition occurs, the slide member 64 may then be moved to a closed position to increase the mass air flow rate into the combustion zone 23. After feeding fuel through the starting coil 102 for approximately twenty seconds, fuel may then be fed through the vaporizer coil 44 in the manner described previously and, when the temperature within the burner begins to rise, a switch controlling the supply of electricity from power source 108 may then be opened to discontinue the supply of electricity to starting coil 102 and spark plug 114 and the supply of fuel to line 106. As illustrated, the fuel injection tube 117 extends into combustion zone 23. Thus, to protect tube 117, air is continuously fed through the tube from air line 104. Similarly, air is continuously fed through the vaporizer coil 44 during start-up to protect the vaporizer coil from excessive heating.

As discussed, the number of flow passages through the vaporizer coil 44 may be varied to control the speed of response of the fuel supply to the combustion zone 23. By way of example, if a single tube were used to form the vaporizer coil 44, the tube could nominally have a diameter of one unit, a volume of one unit, a surface area of one unit, a cross-sectional area of one unit and a length of one unit. If tubes were then used for the vaporizer coil which had a diameter of one-half unit, four such tubes could be used to provide a total surface area which would still be one and a total cross-sectional area which would still be one. This would maintain the heat transfer rate through the vaporizer coil 44 at the same level as before. However, by using four tubes with each tube having a diameter of one-half unit, each of the four tubes would have a length of one-half unit and the total tube volume would be reduced to one-half unit.

By using an even greater number of tubes in which each tube had an inside diameter of one-sixth unit, thirtysix tubes would be used to provide a total surface area which would still be one unit and a total cross-sectional area which would still be one unit. However, the total tube volume would then be only one-sixth unit and the length of each of the thirty-six tubes would be one-sixth unit.

The fuel response time is directly related to the volume of the vaporizer coil 44 and, thus, by increasing the number of individual tubes in the vaporizer coil, the response time for the supply of fuel to the burner may be greatly reduced. In a burner which I have constructed that utilizes the principles of the present invention, four individual vaporizer tubes were employed in making up the fuel vaporizer coil 44 with each of the four tubes being joined to the fuel supply tube 46. This provided a fuel response time of about one second which met the operational requirements of the particular burner. However, if a shorter response time had been required, a larger number of tubes could have been utilized in forming the vaporizer coil 44.

Figure 2:
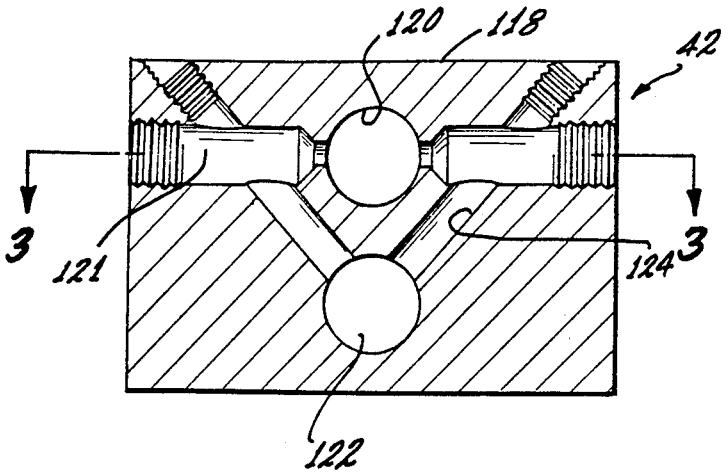
FIG. 2 is a top sectional view of a fuel-air mixer in which fuel and air may be mixed prior to passage of the fuel through the fuel vaporizer.
Figure 3:
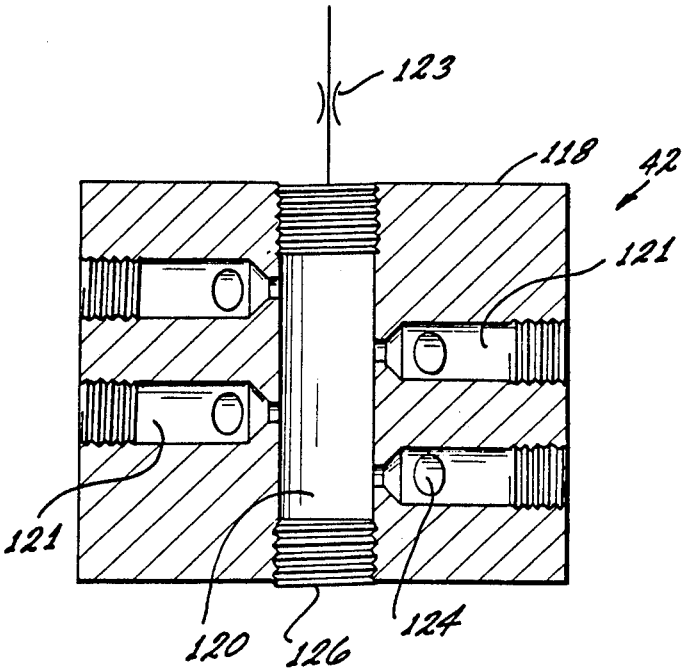
FIG. 3 is a vertical section view through the fuel-air mixer taken along line 3—3 of FIG. 2.

As discussed, the fuel flowing through the vaporizer coil 44 is transported in an air stream and it has been found that this greatly increases the speed of vaporization within the vaporizer coil so as to reduce the fuel response time for the burner. In admixing the fuel with air, a fuel-air mixer 42 may be employed and one form of such a mixer is shown in FIGS. 2 and 3. FIG. 2 is a vertical section through the mixer and FIG. 3 is a horizontal section through the mixer along the line 3—3 of FIG. 2.

As shown in FIG. 2, the mixer 42 may include a block 118 having a longitudinally positioned air passage 120 and a longitudinally positioned fuel passage 122 positioned beneath the air passage. The longitudinal air passage 120 is connected to a plurality of branch passages 121 which may conveniently be four in number if four separate tubes are used in forming the vaporizer coil 44. In injecting fuel into the separate branch passages 121, a plurality of upwardly directed fuel branch passages 124 each connect to the fuel passage 122 and lead to one of the air branch passages. The end of the longitudinal air passage 120 may be closed in any convenient manner such as by a plug (not shown) which engages the internal threads 126 within the air passage.

In maintaining the air flow rate through air passages 120 and branches 121 relatively constant, an orifice 123 may be positioned within the air supply line ahead of the fuel-air mixer 42. Also an orifice may be provided ahead of passage 122 and in the passages 124 where they join passages 121 and also in passages 121 where they join passages 120.

As stated, by conveying the fuel through the vaporizer coil 44 in an air stream, the response time of the fuel vaporizer has been greatly improved. In achieving this result, the ratio of the air and fuel flow rates through the vaporizer coil 44 may be varied providing that there is a sufficient quantity of air to produce dispersed flow within the coil in which the fuel is carried by the air as tiny droplets which are brought into contact with the heat exchange surfaces of the vaporizer coil due to the flow conditions within the coil. In practice, I have used an air flow rate through vaporizer coil 44 which provides about 100 to about 200 volumes of air per volume of liquid fuel. This is a weight ratio of air to fuel of about 1 to 5. The large difference between the volume ratio of air to fuel, as compared with the air-to-fuel weight ratio, is explained by the fact that air at standard conditions has a density of about 0.075 pounds per cubic foot, whereas a typical liquid fuel may have a density of about 51.6 pounds per cubic foot.

The vast improvement in fuel response time which is achieved by carrying the fuel through the vaporizer in a gas stream, such as air, may be appreciated by comparing the results which occur when liquid fuel is fed directly to a vaporizer coil, such as the coil 44. If liquid fuel were fed directly to coil 44, the flow rate of the fuel as it entered the coil would be relatively slow, such as 0.25 feet per second, and would continue to be slow until such time as the fuel was partially vaporized. In feeding liquid fuel to a vaporizer coil, there is, thus, a first heat-exchange zone with a slow flow rate in which all of the fuel is in a liquid state. With partial vaporization of the fuel, a second heat-exchange zone is produced within the vaporizer coil in which the fuel is produced within the vaporizer coil in which the fuel is partly liquid and partly vapor. Within this second zone, the flow rate is increased but is still relatively slow. On complete vaporization of the fuel, a third heat-exchange zone is created within the vaporizer coil which contains only vaporized fuel and the flow rate within this zone is higher such as in excess of sixty feet per second.

As described, the limiting consideration in determining fuel response time when liquid fuel is fed directly to a vaporizer coil is the time required in the first heat-exchange zone in which all of the fuel is in a liquid state. To illustrate, when the fuel supply to such a vaporizer coil is shut off, the third heat-exchange zone may be viewed as moving rearwardly through the heat exchanger coil with the result that the second heat-exchange zone is then converted to a state in which all of the fuel is vaporized. Following this, the third zone moves into the first zone and the first zone is then converted to a state in which all of the fuel is vaporized. When the liquid fuel in the first zone has been converted to vapor, the fuel flow rate of the material in the first zone then rapidly transforms from a flow rate of about 0.25 feet per second to one in excess of sixty feet per second in the flow of the fuel from the vaporizer coil.

As described, the fuel flow response may be relatively slow in a fuel vaporizer system where liquid fuel is directly fed to the vaporizer coil. As applied to the present burner, such a slow response time could permit the temperature within the combustion zone 23 to rise to unacceptable levels or to fall to unacceptable levels when the mass flow rate of air to the combustion zone was abruptly altered. It is, thus, a great advantage in the present burner to feed the fuel in dispersed flow within a gaseous stream, such as air, as the fuel passes through the vaporizer coil 44. This, together with adjusting the number of individual tubes in the vaporizer coil, permits the obtaining of a relatively rapid fuel response time so that changes in the mass air flow rate to the combustion zone 23 may be accommodated by a correspondingly rapid change in the fuel flow rate to the combustion zone to maintain the fuel-to-air ratio and combustion temperature relatively constant.

As described, the annular air inlet opening 22 and the secondary air inlet openings 60 in the present burner may be fixed in size. Also, however, if desired, either the air inlet opening 22 or the secondary air inlet openings 60 or both may be made adjustable. This would, then, permit varying the ratio between the air inlet opening 22 and the secondary air inlet openings 60. Such an arrangement would be desirable if the temperature of the air being supplied to the burner were elevated to a relatively high temperature. In this instance, less air would have to be supplied to the combustion zone 23 to attain the desired combustion temperature while more air would have to be supplied through inlet openings 60 to cool the combustion products to the desired level for the secondary dilution zone 61.

Also, as described, the present burner has three zones, namely a combustion zone 23, a secondary dilution zone 61, and a tertiary dilution zone adjacent the inlet openings 62. However, the invention is not limited to this configuration. Rather, the principles of the invention may be applied to a burner having a plurality of separate zones with each of the zones being maintained at a relatively constant temperature by feeding a portion of the air through the burner wall to cool the combustion products to a first temperature to perform a given work function, then cooling these combustion gases to a second temperature to perform a second work function, then cooling the combustion gases to a third temperature to perform a specified work function, etc. Also, the combustion gases from the combustion zone may be split into several streams with one stream being cooled to one temperature to perform a work function while a second stream is cooled to a different temperature to perform a different work function. Many heat transfer operations may be more advantageously carried out at a specific elevated heat-transfer temperature and, in this manner, a whole host of heat transfer operations may be carried out with a single burner with each of the various zones within the burner having a relatively fixed temperature designed for performance of a particular heat transfer function.

In opening and closing the slide member 64, as described, the total heat output from the burner may be varied. Thus, with the slide member 64 closed, the mass flow of air to the combustion zone 23 is increased and the total heat output from the burner is increased. However, with the slide member 64 in an open position, the mass flow of air to the combustion zone 23 is reduced and the total heat output from the burner is reduced. This variability in heat output from the burner is advantageous when the burner is being used to perform a specific work function such as the conversion of liquid nitrogen to gaseous nitrogen in the heat exchanger 86. For example, if the need for gaseous nitrogen is reduced, the slide member 64 may be moved to its fully opened position to provide a decreased flow of heat to the heat exchanger. On the other hand, if there is an increased need for gaseous nitrogen, the slide member 64 may be moved to a partially or fully closed position to increase the heat output from the burner in order to match the heat output with the needs of the heat exchanger 86. The heat output from the burner 2 may, of course, be used to perform any desired work function. Thus, for example, the combustion gases from the burner 2 may be used to power a turbine to generate electricity.

I claim:

1. In a heat exchanger characterized by a low pressure drop thereacross as compared to the pressure level at which said heat exchanger operates, said heat exchanger for vaporizing liquid, and having a tube which provides a flow path through the heat exchanger, said low pressure drop being created in said tube, an improvement comprising:

an orifice in flow relation with said tube wherein a fluid flowing in said tube at a liquid inlet flow rate enters in a liquid state into said tube through said orifice and is converted into a gaseous state downstream in said tube at a distance from said orifice at a tube pressure, said fluid in gaseous state exiting said tube at a gas outlet flowing;

said orifice being disposed at the input of said tube and being sized to provide an inlet pressure drop to said liquid fluid entering said tube which inlet pressure drop is set equal to a fractional portion of said low pressure drop across said tube, said fractional portion having an absolute magnitude at least large enough so that the absolute magnitude of the change in said gas outlet flow rate produced by any given change in said tube pressure is greater than the absolute magnitude of the change in said liquid inlet flow rate produced by said same given change in said tube pressure, whereby time dependent fluctuations of the fluid flow within said tube may be avoided.

2. The improvement of claim 1 wherein liquid nitrogen enters said orifice and is converted into gaseous nitrogen in said tube.

3. An improvement in a method for improving heat exchange efficiency in a liquid vaporizer characterized by a low pressure drop thereacross as compared to the pressure level at which said heat exchanger opoerates, comprising the steps of:

supplying a liquid fluid to be vaporized into a supply manifold under pressure;

injecting said liquid fluid into at least one tube downstream from said manifold;

dropping the pressure of said liquid fluid injected into said at least one tube by a predetermined magnitude, said predetermined magnitude of pressure drop being determined by increasing said predetermined magnitude at least to that pressure drop at which the absolute magnitude of the rate of change of the inlet flow rate of said liquid fluid into said at least one tube with respect to changes of pressure within said tube is less than the absolute magnitude of the rate of change of outlet flow rate from said at least one tube with respect to changes of pressure within said tube; and vaporizing said liquid fluid within said tube to create a gas exiting therefrom, whereby time dependent fluctuations of the fluid flow within said tube may be avoided and whereby steady flow rates are established in time through said tube.

4. A method for stabilizing heat exchange efficiency in a vaporizer which has a low pressure drop as compared to the pressure level in said vaporizer, comprising the steps of:

supplying into a supply manifold at a first pressure, a liquid fluid to be vaporized;

transferring said liquid fluid from said manifold into at least one heat exchanging tube communicating with said manifold;

dropping said first pressure of said liquid fluid as said liquid fluid is transferred into said tube to a second pressure, said liquid fluid being characterized by a liquid inlet flow rate into said tube from said manifold;

vaporizing said liquid fluid within said tube downstream from said manifold to create gas at said second pressure; and transferring said gas from said heat exchanging tube to an output manifold, said gas transferred from said tube characterized by a gas outlet flow rate from said tube;

where in said step of dropping said pressure of said liquid fluid from said input manifold into said tube, said pressure is dropped by at least that predetermined magnitude selected by increasing said magnitude of said pressure drop to a magnitude where a change in said second pressure within said tube produces a change in said gas outlet flow rate from said tube, the absolute magnitude of which is greater than the absolute magnitude of the corresponding change in said liquid inlet flow rate into said tube, whereby time dependent fluctuations of said fluid flow through said low pressure drop liquid vaporizer is avoided and whereby steady flow rates are established in time throughout said low pressure drop liquid vaporizer.

* * * * *